US009039344B1

(12) United States Patent
Marcus

(10) Patent No.: US 9,039,344 B1
(45) Date of Patent: May 26, 2015

(54) UNIVERSAL WORK TOOL CONNECTOR DEVICE FOR SKID STEER LOADER

(71) Applicant: Herman H Marcus, St. Croix, VI (US)

(72) Inventor: Herman H Marcus, St. Croix, VI (US)

( * ) Notice: Subject to any disclaimer, the term of this patent is extended or adjusted under 35 U.S.C. 154(b) by 0 days.

(21) Appl. No.: 13/999,499

(22) Filed: Mar. 3, 2014

Related U.S. Application Data

(60) Provisional application No. 61/956,685, filed on Jun. 14, 2013.

(51) Int. Cl.
*E02F 3/36* (2006.01)

(52) U.S. Cl.
CPC ..... *E02F 3/3622* (2013.01)

(58) Field of Classification Search
CPC ..... E02F 3/365; E02F 3/3622; E02F 3/3627; E02F 3/3631; E02F 3/3618
USPC ..... 414/723; 37/231.468; 172/272, 810, 172/811, 817; 403/43.44
See application file for complete search history.

(56) References Cited

U.S. PATENT DOCUMENTS

| | | | | |
|---|---|---|---|---|
| 2,844,397 | A * | 7/1958 | Du Shane | 403/44 |
| 3,220,487 | A * | 11/1965 | Pilch | 172/274 |
| 3,719,377 | A * | 3/1973 | Schultz et al. | 403/44 |
| 3,923,220 | A * | 12/1975 | Marcyan | 224/547 |
| 4,071,105 | A * | 1/1978 | von Allworden | 180/14.4 |
| 4,241,935 | A * | 12/1980 | Vollmer et al. | 172/272 |
| 4,360,980 | A * | 11/1982 | Jarvis | 37/404 |
| 4,986,722 | A * | 1/1991 | Kaczmarczyk et al. | 414/723 |
| 5,520,500 | A * | 5/1996 | McIlwain et al. | 414/685 |
| 6,499,934 | B1 * | 12/2002 | Kaczmarski et al. | 414/723 |
| 6,655,468 | B2 * | 12/2003 | Casali et al. | 172/439 |
| 6,701,630 | B2 * | 3/2004 | Humphrey | 37/403 |
| 7,364,181 | B2 * | 4/2008 | Patterson | 280/504 |
| 8,240,970 | B2 * | 8/2012 | Bricker et al. | 414/723 |
| 2004/0042888 | A1 * | 3/2004 | Westendorf et al. | 414/723 |
| 2004/0067126 | A1 * | 4/2004 | Schmidt | 414/723 |
| 2008/0025830 | A1 * | 1/2008 | Pielmeier et al. | 414/723 |

* cited by examiner

*Primary Examiner* — Joshua Kennedy

(57) ABSTRACT

A connector device enables universal compatibility and interchangeability between any work tool accessory having a boom feature and any skid steer loader as well as controlled support of the work tool accessory. The connector device also prevents machine instability issues.

13 Claims, 13 Drawing Sheets

UNIVERSAL WORK TOOL CONNECTOR DEVICE FOR SKID STEER LOADER

RELATED APPLICATION

This application claims priority from U.S. Provisional Application No. 61/956,685 filed on Jun. 14, 2013, which is incorporated herein by reference.

FIELD OF THE INVENTION

The present invention relates generally to connectors useful for attaching accessory apparatus to earth moving machinery. More specifically, the present invention is directed to a connector device usable to attach an incompatible work tool accessory to an earth moving off road vehicle without machine instability.

BACKGROUND OF THE INVENTION

There are a number of earth-moving machines in the construction and mining industries today. One of the most popular earth-moving machinery is the skid steer loader because it is compact, very maneuverable and its lift arms are usable to attach many different labor saving work tool attachments. Skid steer loaders are also highly desirable because of its favorable weight ratio balance, which is achieved by locating the engine at the rear of the machine, and the load (or work tool attachment) at the front of the machine.

Generally, skid steer loaders have a frame that is moved by independently driven wheels on opposite sides of the vehicle so that by turning the left and right wheel pairs (on each side of the machine) at different speeds and in different directions, the machine turns by skidding across the ground.

In Prior Art FIG. 1, the skid steer loader 10 has a main body frame 12, which includes an operator compartment 14, that is moved by a pair of right and left wheels 16 located on opposite sides of the frame 12. A pair of lift arms 18 is pivotally mounted to the machine's frame 12 on opposite sides of the operator's compartment 14. Each lift arm 18 is equipped with a hydraulic lift cylinder 20 that raises and lowers the lift arm 18 in a vertical direction as desired.

As depicted in Prior Art FIG. 1, a work tool accessory in the form of a bucket 22 is attached to the lift arms 18. This attachment is accomplished by a work tool accessory mounting frame or coupler 24 illustrated in Prior Art FIG. 2. The work tool accessory coupler 24 is pivotally connected at 25 to a distal end of each lift arm 18. Each lift arm 18 is equipped with a hydraulic tilt cylinder 21, which is also attached to the work tool accessory coupler 24 as shown. As constructed, actuation of hydraulic tilt cylinder 21 causes the coupler 24 to tilt or retract backwards and forwards, away from and towards lift arm 18.

At its upper and lower regions, the work tool accessory coupler 24 is constructed with a lip 26 and locking pin 28, respectively, both of which fits matingly into corresponding upper and lower regions, respectively, of a work tool accessory attachment surface, that allows bucket 22 to be attached to the distal end of each lift arm 18, as shown in Prior Art FIG. 1.

Different types of work tool accessories are interchangeably attached and released from the machine 10. For this reason, a functional appeal of skid steer loaders is the ability to use a wide variety of work tool accessories or attachments for a variety of different uses. These work tool accessories or attachments are often powered by the loader's hydraulic system and include, for example, excavators, earth augers, specialized buckets, hydraulic breakers, snow blowers, trenchers, cement mixers, rippers, backhoes, pallet forks, wheel saws, etc.

In the illustration shown in Prior Art FIG. 3, the work tool accessory is in the form of a backhoe 34. As depicted, the attachment surfaces 30, 32 of the backhoe 34 is configured to fit lip 26 and pin 28 in the corresponding upper and lower regions, respectively, of the work tool accessory coupler 24 in Prior Art FIG. 2.

The upper region of the work tool accessory coupler 24 that is constructed with a lip 26 (Prior Art FIG. 2), for instance, fits matingly into a flange portion 30 (Prior Art FIG. 3) located in an upper region of the attachment surface of work tool accessory 34. Similarly, the lower region of work tool accessory coupler 24 that is constructed with a locking pin 28, is matingly fitted into aperture 32 located in a lower region of the attachment surface of work tool accessory 34. Once these mating connections are made, the work tool accessory 34 in Prior Art FIG. 3, like bucket 22 in Prior Art FIG. 1, is connected to the skid steer loader 10.

However, unlike the attachment of a compact tool like bucket 22 in Prior Art FIG. 1 to the skid steer loader 10, attachment of any work tool accessory 34 having a boom feature 36, as shown in Prior Art FIG. 3, to any skid steer loader 10 causes undesirable and unwanted machine instability even when a pair of stabilizers 38, on opposite sides of the boom feature 36 via work tool accessory 34, are employed. Machine instability is caused by a number of factors including, for example, high stress load of the boom feature 36 on the skid steer loader machine 10 such as during operation. The non-compact nature of the boom feature 36 causes another problem—undesirable forward tipping of the skid steer loader 10 in the direction of the boom feature 36, which is attached at the front or forward end of the loader machine 10. Uncontrollable or unsteady boom feature 36 support is a persistent and pervasive problem when the work tool accessory 34 manufactured by one company is attached to a skid steer loader 10 manufactured by a different company. The complex arrangement of spring locking mechanisms needed to secure the boom feature to the mounting frame is yet another typical problem.

SUMMARY OF THE INVENTION

The present invention solves these and other problems through the use of a connector device that is simplistic in design, does not employ any spring mechanism, and does not require complicated connection to the lift arms of the skid steer loader machine.

In fact, the connector device of the present invention is durable, accommodates high stress loads, and prevents forward tipping and other machine instability issues. In addition, it is easy to install/remove safely and quickly, and ensures controlled support of the work tool accessory to the skid steer loader as well as work tool accessory compatibility. Indeed, the connector device of the present invention is universal in its application to connect any combination of skid steer loader machine to any work tool accessory having a boom feature without regard to whether the machine or work tool accessory is manufactured by different companies. All of the above translates into human and equipment time savings as well as health and cost savings due to, for example, universal equipment compatibility and interchangeability, minimum equipment downtime, danger-free installation and removal in a safe, convenient manner, and the like.

In a preferred embodiment, the present invention comprises an anchor pad, stop pad, anchor hook assembly and one or more c-shaped hooks, all made of high-strength steel to withstand the high and/or reciprocating stresses of the equipment involved. A pair of anchor pads is preferably fixedly attached to the front end frame of the loader machine, inside each lift arm and below the operator's compartment, one on the left and the other on the right. Each anchor pad is preferably in positional alignment for appropriate connection with the hook(s) attached to the work tool accessory. Each anchor pad is shaped to receive a curved hook of the anchor hook assembly.

Preferably, each anchor pad comprises an anchor plate, a pair of flanges and a pin. The flanges are substantially solid and rectangular in shaped, with semi-circularly rounded corners, and are positioned on opposite sides of the anchor plate. Each anchor plate is securely attached to the front end of the loader machine by fasteners, which apertures are preferably positioned one above each flange, and one along the lower edges of the flanges and below the pin approximately at the center. The pin, which may be formed as one element with the flanges and/or anchor plate, is nevertheless fixedly secured to the flanges through the center of both flanges such that the hook in the anchor hook assembly is securably attached to the pin between the flanges.

The stop pad, which is approximately rectangular in shape except for one corner, is preferably a solid block of high strength steel dimensioned to substantially, for example, absorb vibrational stresses caused by the tilt cylinder, resist the breakout force of the work tool accessory including those having a boom feature, overcome undesirable shaking, alleviate unwanted lateral movement, reduce equipment wear and tear, withstand reciprocating and/or vibrational and/or high loads and stresses, and the like.

Preferably, the stop pad is fixedly attached near a distal end on each lift arm in an angular position, which substantially prevents a rear surface of the coupler from retracting. As such, stop pad serves as a backstop or an additional support to backstop the coupler from further retracting movement in the direction towards the lift arm. In a preferred embodiment, the length of the stop pad covers a substantial length of the rear surface of the coupler that it backstops. By this design and arrangement, the stop pad serves to substantially eliminate slack between the skid steer loader and the work tool accessory especially during operation.

As to the one or more c-shaped hooks of the present invention that is preferably attached in alignment to a top surface of the work tool accessory, in a way that positions the open space of the hook towards the boom feature of the work tool accessory, the size of the open space of the hook substantially accommodates the contouring shape of the cylindrical pin for the anchor hook assembly. In addition, each hook is sized for strength to withstand high reciprocating and/or vibrational stress and loads generally associated with a work tool accessory having a boom feature.

As such, in a preferred embodiment of the invention, each hook's configuration in the general form of a "c" comprises a base portion, rear, sloping back region, width, and bottom substantially overcoming a maximum breakout force of the work tool accessory by, for example, a generally wide and thick base portion from front to rear below and behind the open space of the hook; a back region sloping upwardly from the rear to a top point of its "c" shape; a back region which slope inclines at each point between zero and 90 degrees between the hook's rear and a top point of its "c" shape; a width, which extends from the front to the rear and below the hook's open space (also bottom), that generally decreases from the bottom of the hook upwardly to a top point of its "c" shape (top); the hook's rear, which slope declines approximately at each point between zero and 90 degrees or, alternatively, which slope inclines approximately at a rate greater than the incline of sloping back region; a substantial portion of the base portion of the hook extends approximately beyond a beginning of the "c" shape configuration of the hook; the slope of the base portion declines approximately at each point between zero and 90 degrees.

Each hook, along the width of the hook, is preferably fixedly attached to a top surface of the work tool accessory, preferably in the vicinity of each side of the support base of the control panel. In this regard, one hook may be attached employing a cut-out in the control panel to receive the cylindrical pin of the anchor hook assembly, or a pair of hooks may receive the cylindrical pin in their open spaces on either side of the control panel.

Preferably, the pair of hooks comprises a first part, which includes two hooks fixedly secured in spaced relation to each other on one hook plate, for one side of the control panel, and a second part, which includes two hooks fixedly secured in spaced relation to each other on another hook plate, for the other side of the control panel. The hooks are as earlier described, and in the first and second parts may be formed as one element with the hook plate or as separate elements preferably secured through the use of an electrode suited to weld the materials loader machines and work tool accessories are made of, preferably with a minimum yield strength of approximately 68,000 psi and a tensile strength of approximately 78,000 psi.

Preferably, the first part and second part of the pair of hooks operate in complement with the work tool accessory, such as the control panel. For example, for the first part, while the pair of c-shaped hooks are in spaced relation to each other on the hook plate in such a way that the open space of each hook is facing the boom feature of the work tool accessory, one of the hooks is positioned nearest the left side edge of the hook plate, such as approximately one-half inch from the left edge of the hook plate. Preferably one or more apertures, to the right of this hook, is spaced alongside the width of the left-edge hook. As the second hook is already in spaced relation to the left-edge hook, in order to accommodate the cylindrical pin, accordingly another one or more apertures is spaced to the right thereof.

For the second part, one of the two hooks is positioned nearest the right edge of the hook plate, such as approximately one-half inch from the right side edge of the hook plate. Preferably one or more apertures, to the left of this hook, is spaced alongside the width of the right justified hook, as are the one or more apertures spaced adjacent the right of the second hook thereof.

The left justified configuration of the first part and the right justified configuration of the second part of the pair of hooks operates complementarily with the control panel of the work tool accessory in that placement of the left justified hook configuration of the first part complements the left hand side of the control panel, and placement of the right justified hook configuration of the second part complements the right hand side of the control panel.

In addition, this configuration and arrangement of the first and second parts of the pair of hooks significantly reduces cost, time, human effort and health dangers because in part it provides universal boom feature compatibility and interchangeability with minimum machine downtime in a safe, easy convenient way.

As will be discussed in more detail later, the anchor hook assembly of the present invention preferably comprises one of an adjusting bolt, hex nut, anchor hook, cylindrical pin and washer assembly. The anchor hook assembly is elongated in design and has two ends. In a preferred embodiment, one end comprises an anchor hook in the shape of a "c" that is threadedly attached to an elongated adjusting bolt, which has at its other end, a solid cylindrical pin, lock washer and a bolt head. Intermediate of both ends of the anchor hook assembly is an elongated hex nut, which is threadedly attached onto the adjusting bolt and the anchor hook. The anchor hook assembly is preferably made of alloy steel with a zinc finish designed to reduce corrosion.

The present invention is designed to withstand the maximum total machine rated capacity, which includes the rated operating loads for the lightest and heaviest skid steer loader machines. In a preferred embodiment, the present invention withstands the heaviest skid steer machine equipped with a work tool accessory having, for example, a boom, control panel, stick, stabilizer and a heavy duty bucket or backhoe.

There has been thus outlined, rather broadly, a summary of the invention in order that a detailed description thereof that follows may be better understood, and in order that the present contribution to the art may be better appreciated. There are, of course, additional aspects of the invention that will be described hereinafter and which will perform the subject matter of the claims appended thereto.

In this respect, before explaining an embodiment of the invention in detail, it is to be understood that the invention is not limited in its application to the details of construction and to the arrangements of the components set forth in the following description or illustrated in the drawings. For example, terms such as "horizontal", "vertical", "side", "top", "bottom", "upper", "lower", "left", "right", "width", "length", and the like, are used merely to describe a point of reference and does not necessarily limit the invention to any specific orientation. In a similar fashion, references to singular forms, such as "an", "the", "a", for example, do not necessarily denote a limitation of quantity as used in the specification and claims, but rather denotes the presence of at least one of the referenced items, components or elements unless indicated otherwise. Also, it is to be understood that the phraseology and terminology employed herein are for the purposes of description and should not be regarded as limiting.

As such, those skilled in the art will appreciate that the conception, upon which this disclosure is based, may readily be used as a basis for the designing of other structures, methods and systems for carrying out the several aims of the present invention. It is important, therefore, that the claims be regarded as including such equivalent constructions insofar as they do not depart from the spirit and scope of the present invention.

BRIEF DESCRIPTION OF PREFERRED EMBODIMENTS

Prior Art FIG. 1 is a side view of a conventional skid steer loader machine showing raised and lowered positions of its lift arms.

Prior Art FIG. 2 is a side view of a conventional skid steer loader showing a mounting frame.

Prior Art FIG. 3 is an angle view of a conventional work tool accessory having a boom feature.

DETAILED DESCRIPTION OF PREFERRED EMBODIMENTS

Figure 1:
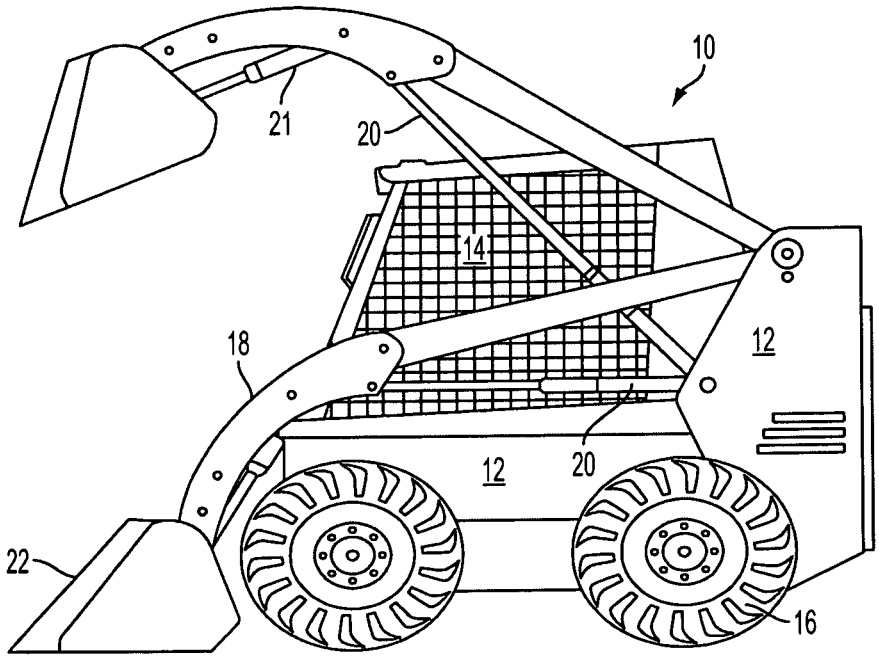
FIG. 1 PRIOR ART
Figure 2:
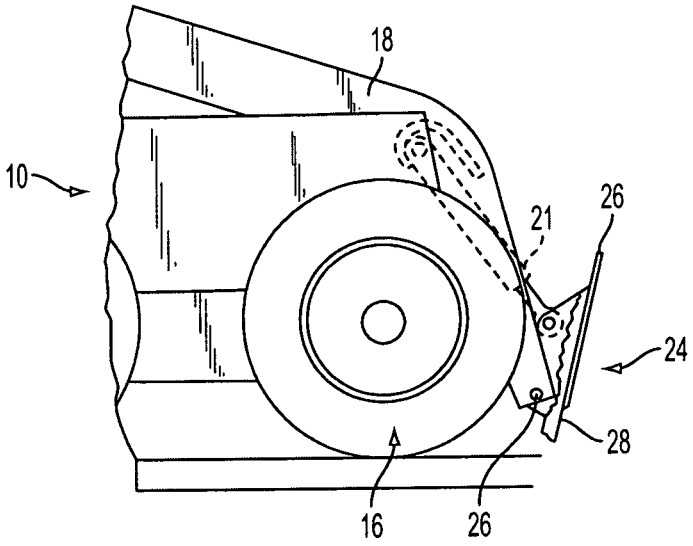
FIG. 2 PRIOR ART
Figure 3:
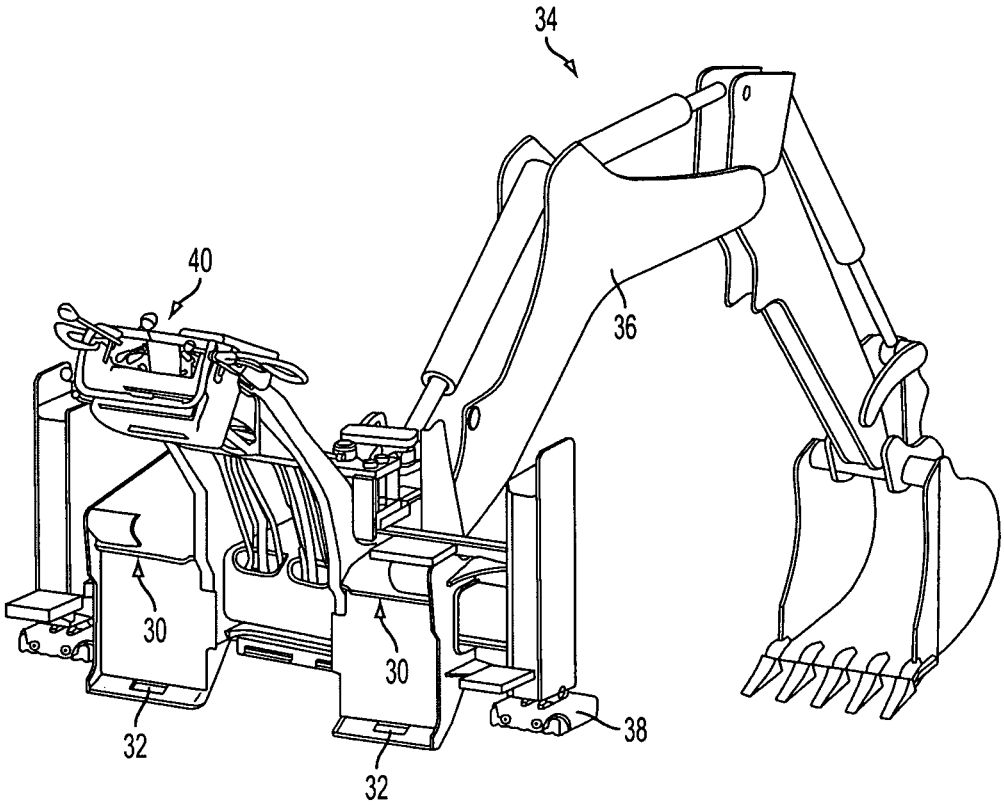
FIG. 3 PRIOR ART

The connector device of the present invention comprises several elements or components including one or more anchor hook assembly 50, anchor pad 60, hook 70 and stop pad 80 that stably couples and/or anchors any work tool accessory 34 having a boom feature 36 to any skid steer loader 10.

Figure 4:
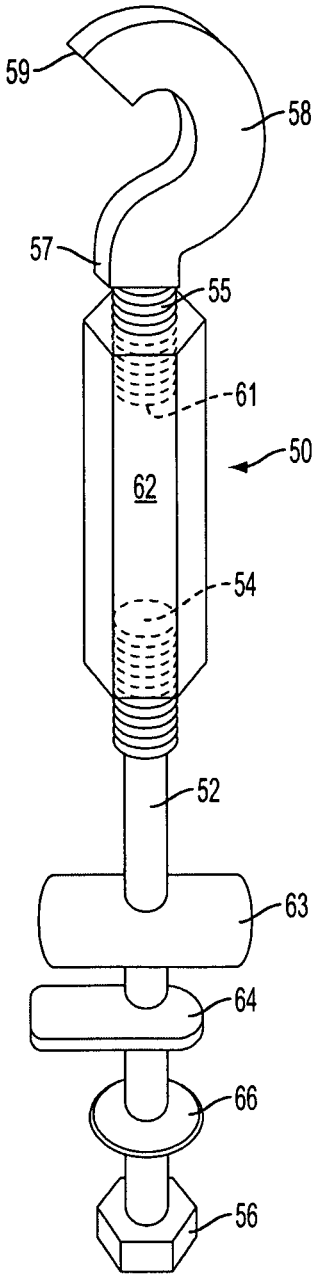
FIG. 4 is the anchor hook assembly component of the connector device of the present invention according to a preferred embodiment.

Referring to the figure drawings wherein like reference numerals indicate like elements, there is shown in FIG. 4 an anchor hook assembly of the connector device according to a preferred embodiment.

The anchor hook assembly 50 of the present invention comprises several components. One such component is a single adjusting end stud bolt 52. In a preferred embodiment, adjusting bolt 52 is made of quenched and tempered medium carbon alloy steel having a proof load of approximately 120,000 pounds per square inch (psi), a minimum yield strength of approximately 130,000 psi, and a minimum tensile strength of approximately 150,000 psi. Generally, proof load refers to the axial tensile load that the product or material must withstand without evidence of any permanent set; yield strength refers to the maximum load at which a material exhibits evidence of permanent deformation; and tensile strength refers to the maximum load in tension (pulling apart) that a material can withstand before breaking or fracturing.

Bolt 52 is preferably a grade 8 strength SAE steel bolt with a diameter measuring one inch, configured to withstand the pulling power and reciprocating stresses of a skid steer loader 10 and work tool accessory 34 having a boom feature 36.

In a preferred embodiment, adjusting bolt 52 measures at least approximately eight inches in length, not including hexagonal bolt head 56, and is preferably marked with six radial lines. Its maximum length varies, depending, for example, on the coupled distance between a loader machine 10 manufactured by one company and the work tool accessory 34 having a boom feature 36 manufactured by the same or different company.

The length of bolt 52 ranges in measurement from approximately eight to sixteen inches, as desired, depending on the connectional distance between anchor pad 60, which is preferably positioned on the skid steer loader 10, and hook 70, which is positioned on a top surface of the work tool accessory 34, after the loader machine 10 and the work tool accessory 34 having a boom feature 36 are coupled together via coupler 24. If additional bolt length is desired or necessary, it is preferable to increase the length of the non-threaded portion of bolt 52 rather than increase its thread length so as not to diminish the strength of bolt 52.

One end 54 only of adjusting bolt 52 is threaded. The remaining portion of bolt 52 is non-threaded and its non-threaded end has a hexagonal bolt head 56. End 54 is depicted in dashed lines to indicate its hidden threaded view inside an elongated hex nut 62. In a preferred embodiment, bolt 52 is coarsely threaded from end 54 inwardly, towards its non-threaded portion, and its thread length ranges from approximately two and three-quarter inches to three and three-quarter inches to facilitate appropriate axial adjustments of the adjusting bolt 52 along hex nut 62. Preferably, the thread length of adjusting bolt 52 depends on the connectional distance between anchor pad and hook 70, with a thread count of approximately nine threads per inch, or desired pitch and thread angle.

In a preferred embodiment, end 54 of adjusting bolt 52 is matingly threaded into a hex nut 62. Hex nut 62 is preferably made of high strength steel and measures a minimum range of approximately four and one-half inches to ten inches in length, again, depending on the coupled distance between anchor pad 60 and hook 70. In one application of the present invention where, for example, adjusting bolt 52 is a Grade 8 strength SAE steel bolt measuring approximately eight inches long, having an approximate thread length of two and three-quarter inches at nine threads per inch at end 54, and a diameter measuring approximately one inch, hex nut 62 is approximately four and one-half inches long.

Yet another component of the anchor hook assembly 50 is an anchor hook 58, preferably in the shape of a "c", which using coarsely threaded element 55, is threadedly attached to hex nut 62. Like end 54 of adjusting bolt 52, end 61 of element 55 is matingly threaded into hex nut 62. In addition, end 61 is depicted in dashed lines to indicate its hidden threaded view inside of hex nut 62.

In a preferred embodiment, anchor hook 58 and threaded element 55 are formed as one component also made of high strength steel. The length of element 55 that is available for threading into hex nut 62 ranges between approximately two and one-half inches to three and one-half inches, culminating at end 61. Regarding the length of hook 58, it is approximately four and one-quarter inches long, measuring from the bottom of its base portion 57 to a top surface of its "c" curvature. As depicted, the beginning of the "c" shape configuration of hook as at point 59 is sufficiently overhanging in order to facilitate a secure strength hooked connection onto pin 74 in anchor pad 60 without unfastening. Also, anchor hook 58 is preferably approximately one inch thick along its entire "c" shaped curvature including into its base portion 57. Again, anchor hook 58 and threaded element 55 withstand the pulling forces, among other stresses and load, involved between the loader machine 10 and the work tool accessory 34 having a boom feature 36.

Alternatively and optionally, hook 58 and threaded element 55 may be two separate components where threaded element 55 is fixedly attached to anchor hook 58 at its base portion 57. The fixed attachment may be in the form of threading, welding or the like. Preferably here, between approximately two to three inches of element 55 is fixedly attached to the base portion 57 of anchor hook 58, and between approximately two to three inches of element 55 is fixedly attached to hex nut 62 via end 61, to withstand the pulling power, among other forces, involved between the loader machine 10 and the work tool accessory 34 having a boom feature 36.

Yet another component of the anchor hook assembly 50 is a cylindrical pin 63, which is preferably located between the threaded portion of adjusting bolt 52 and bolt head 56. In a preferred embodiment, cylindrical pin 63 is a solid, tubular shaped pin made of high strength steel that slides axially along the diameter of adjusting bolt 52. The length of cylindrical pin 63, which is perpendicular to adjusting bolt 52, is preferably between the range of approximately three and one-half inches to five inches, and its diameter is preferably between the range of approximately one and three-quarter inches to two inches.

Importantly and preferably, the axial areas of cylindrical pin 63 immediately adjacent to and on opposite sides of the diameter of adjusting bolt 52, are supported to withstand the pulling forces and/or reciprocating stresses caused by the work tool accessory 34. For example, in FIG. 8, these axial areas of cylindrical pin 63 are preferably supported on the one side by hook 70, and on the other side in the base portion of control panel 40 via cut-out 86. Similarly in FIGS. 12 and 13B, for example, the axial areas of cylindrical pin 63 immediately adjacent to and on opposite sides of the diameter of adjusting bolt 52, are preferably supported on both sides by a pair of hooks 70 via the open spaces 82 of those hooks 70. In the embodiments depicted in FIGS. 8, 12 and 13B, for instance, a preferred support distance of these axial areas of cylindrical pin 63—namely the axial areas of cylindrical pin 63 immediately adjacent to and surrounding the diameter of adjusting bolt 52—is the approximate size of the lock washer 64, which is approximately two inches.

In one application, cylindrical pin 63 is approximately three and one-half inches long with a diameter of approximately one and three-quarter inches of solid high strength steel, except for the one-inch diameter hole therethrough that accommodates adjusting bolt 52. In addition, cylindrical pin 63 is preferably sized or shaped to fit matingly into open space 82 of hook 70, and vice versa.

Adjacent to cylindrical pin 63 in FIG. 4, and another component of the anchor hook assembly 50, is a washer assembly 64, 66, also located on the unthreaded portion of adjusting bolt and preferably in the vicinity of bolt head 56. Washer assembly 64, 66 comprises one or more types or kinds of washers designed to prevent loosening due to vibration and dynamic loads.

In a preferred embodiment, washer assembly 64, 66 takes the form of an unthreaded wedge lock washer assembly 64, 66 where wedge washer 64 is used in back-to-back relation with a plain or flat washer 66. In facial engagement with each other and bolt head 56, assembly 64, 66 exhibits vibration resistant qualities by resisting vibrational and/or dynamic load loosening of cylindrical pin 63 from open space 82 in hook 70. Also preferably made of high strength alloy steel, lock washer assembly 64, 66 achieves desired wedge and axial tensile strengths to withstand equipment pulling forces involved.

As to dimensions, washer assembly 64, 66 is appropriately sized to accommodate the connectional spacing involving the assembly 64, 66, cylindrical pin 63, hook 70 and, to some degree, bolt head 56. In a preferred embodiment, wedge lock washer 64 is generally rectangular on the bottom end having rounded corners, and semi-circularly round on the top end. Wedge lock washer 64 is appropriately sized to substantially prevent, among other things, lateral movement of cylindrical pin 63.

Wedge lock washer 64, which has opposing flat faces on either side, is approximately three-eighths of an inch in thickness, and accommodates the one-inch diameter of adjusting bolt 52 near its semi-circularly rounded top end. The majority of its remaining approximately three inch length is sized and shaped to form a wedge on its rectangular-shaped bottom end, against the top surface of the work tool accessory 34, that substantially locks cylindrical pin 63 into hook 70 (see FIG. 8). Preferably, wedge lock washer 64 is approximately two inches wide and is also made of high strength steel. Washer 66 also slides axially along adjusting bolt 52.

Figure 5A:
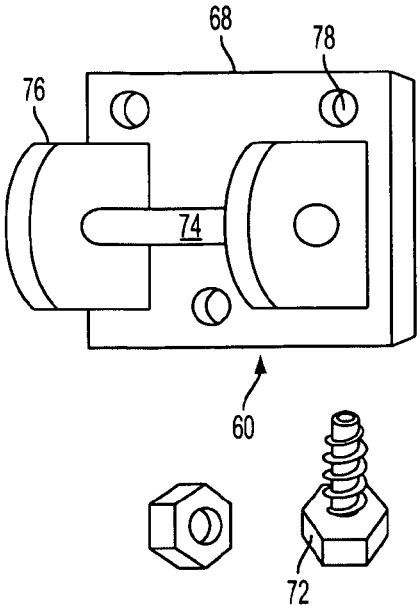
FIGS. 5A, 5B and 5C are an angular, front and side views of the anchor plate of the connector device of the present invention according to a preferred embodiment.
Figure 5B:
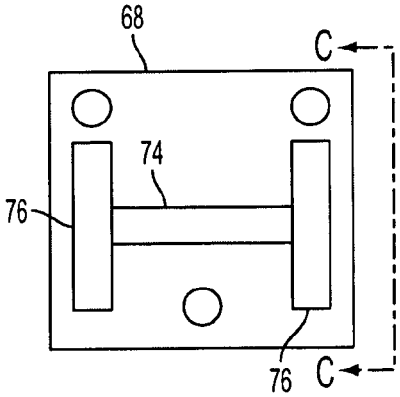
Figure 5C:
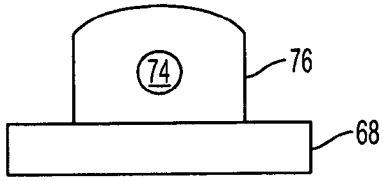

Anchor pad 60, in FIGS. 5A, 5B and 5C, preferably comprises an anchor plate 68, a pin 74, and a pair of flanges 76. By design, anchor pad 60 is configured for secure connection onto the front end of the loader machine 10 via two or more fasteners 72, and for secure hooking connection by the c-shaped anchor hook 58 of the anchor hook assembly 50.

As illustrated in the preferred embodiment depicted in FIG. 5A, anchor plate 68 includes two solid flanges 76 with semi-circularly rounded corners, facing each other and spaced on opposing sides of the plate 68. Preferably, flange 76 is approximately four inches high by four inches wide, except for the rounded corners, and approximately one-half inch thick.

A pin 74, such as a dowel pin shown in FIGS. 5A, 5B and 5C, preferably having a diameter of approximately one and one-quarter inches and approximately three inches in length, fixedly attaches both flanges 76 approximately through the center of both flanges 76 such that anchor hook 58 is securably attachable to pin 74 between flanges 76. The diameter of pin 74 may range between approximately one and one-quarter inches to one and one-half inches. Alternatively and optionally, flanges 76 and pin 74, and/or flanges 76, pin 74 and plate 68 may be formed as one element.

Preferably each element of the anchor pad 60 is made of high strength steel and constructed to withstand the digging and/or pulling forces of the work tool accessory 34 having a boom feature 36 that is attached to the skid steer loader 10. The thickness of anchor pad 60 may range between approximately one-half to an inch.

As is apparent to one skilled in the art, a change in one dimensional aspect (length and/or height and/or thickness) of anchor pad 60 generally results in a change in another dimensional aspect of the pad 60 in order to maintain a desired minimum component strength that withstands the reciprocating forces of the equipment involved. For example, if the size of flange 76 is reduced in size to occupy less space, such as from a four-inch square to an approximately three-inch square, then it follows that the thickness of flange 76 would necessarily increase from one-half inch to approximately three-quarter inch to be of sufficient strength to withstand the digging forces of boom feature 36.

Anchor plate 68 is preferably dimensioned approximately five inches wide, six and one-half inches high, and three-quarter inch thick, and contains a plurality of apertures 78 for fastening onto the main frame of loader 10 via fasteners 72. Fastener 72 preferably comprises an appropriate length hexagonal bolt and nut. In order to withstand the generally downwardly pulling forces of the boom feature 36 that are translated onto anchor plate 68, a minimum of two apertures 78 is preferably located at the top of plate 68. For best results, one aperture is preferably positioned above each flange 76, which are approximately three inches apart. A third aperture 78 is preferably located below pin 74 and at a location approximately central between each flange 76 and in line with the vicinity of a bottom edge of flange 76.

The third element in the connector device of the present invention is a hook 70, sized not only to accommodate the contouring shape of the cylindrical pin 63 in anchor hook assembly 50 but also for strength to accommodate the high and/or reciprocating stresses generally associated with the boom feature 36 of work tool accessory 34.

Figure 6:
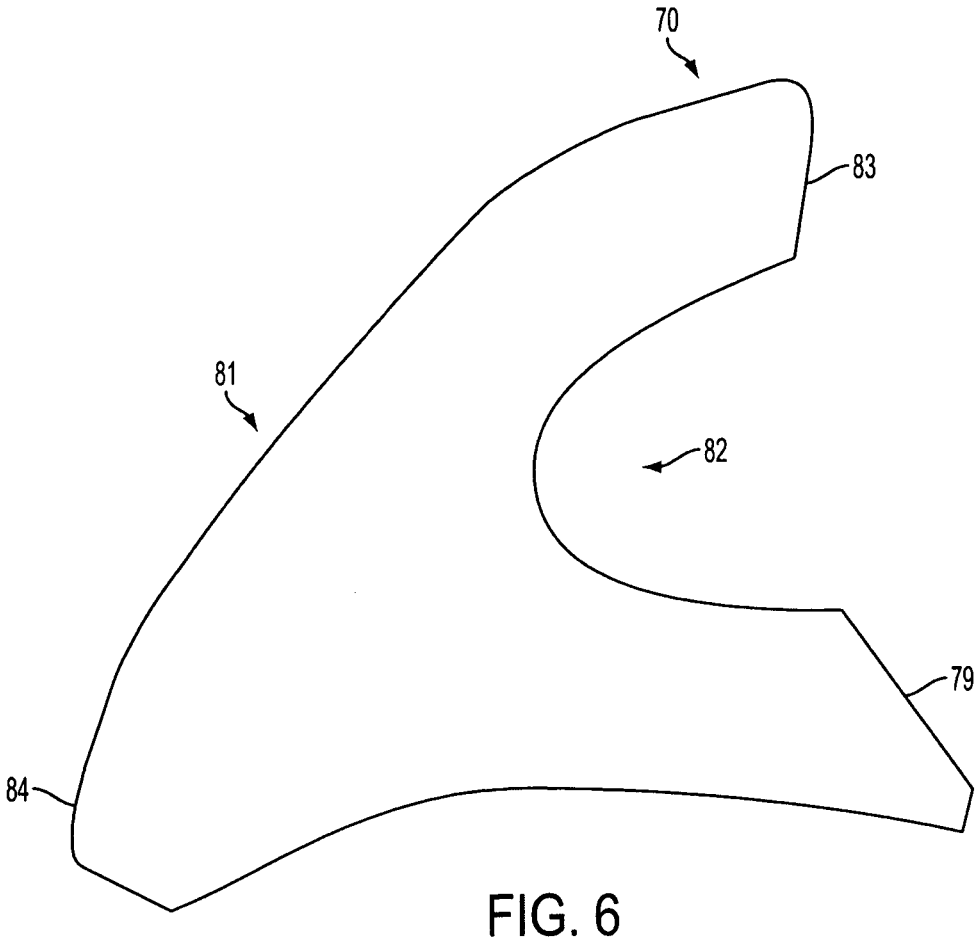
FIG. 6 is a side view of the hook component of the connector device of the present invention according to a preferred embodiment.

In a preferred embodiment depicted in FIG. 6, hook 70 is in the general form of a in order to accommodate the cylindrical pin 63 in open space 82. In other words, in an exemplary application where cylindrical pin 63 has a diameter measuring approximately one and three-quarter inches, the inner contour of open space 82 is correspondingly sized to measure approximately one and three-quarter inches in order to accommodate pin 63. Also, the thickness of hook 70 may range from approximately one-half of an inch to one inch. A horizontal base portion 79 of hook 70 is configured to absorb, accommodate or withstand the pulling power of the work tool accessory 34 having a boom feature 36 without breakout, where its width ranges from approximately five and one-half inches to about six inches in the area proximately below open space 82 extending from the front (near reference number 79) to rear 84. The height of hook 70 may range from approximately five to six inches, such as five and one-half inches.

Moving upwardly from rear 84, behind open space 82 and towards point 83, is a sloping back region 81, similarly designed for strength in that back region 81 generally decreases gradually in width from rear 84 upwardly towards point 83, and at an angle at one or more points along region 81 between approximately ten and 90 degrees. As such, the slope of back region 81 provides substantial strength support against breakout forces for the area of hook 70 below open space 82 as well as the area behind open space 82 (i.e. area between reference numbers 82 and 81).

Preferably, several factors contributing to a configuration of hook 70 as depicted to overcome a maximum breakout force of boom feature 36 generally include: a relatively wide and thick bottom half, best represented by the area between and below reference numbers 81 and 82, approximately forming a substantial portion or area of the hook 70, approximating two-thirds of the area of hook 70; a back region 81 generally sloping upwardly from rear 84 towards the top of its "c" curvature, as at 83; a back region 81 sloping at one or more points therealong at a gradual incline between zero and 90 degrees to a top point on its "c" shape (in the vicinity of reference number 70); a hook width that generally decreases in a direction from the bottom—between rear 84 and the front (near reference number 79)—upwardly towards a top point of its "c" shape, as at 83; a rear 84 which slope inclines at a rate greater than the slope of back region 81; the base portion 79 characterized by a slope that declines at each point approximately at an angle between zero and 90 degrees; and, a substantial portion of base portion 79 extending approximately beyond a beginning of the "c" shape configuration of hook 70 as at point 83, and below open space 82.

By way of exemplary installation (FIG. 8), the bottom of hook 70 is fixedly attached to a top surface area of work tool accessory 34, preferably in the vicinity of each side of the support base of control panel 40 and in alignment for a secure hooking connection of anchor hook 58 and pin 74 of anchor plate 60. A preferred embodiment for fixedly attaching hook 70 is through the use of a low hydrogen covered electrode or an iron powder low hydrogen moisture resistant electrode, suited to weld the variety of materials that loader machines 10 and work tool accessories 34 are made of. Accordingly, use of a direct current electrode positive with a minimum yield strength of approximately 68,000 psi and a tensile strength of approximately 78,000 psi to fixedly attach hook 70 is preferable.

Figure 8:
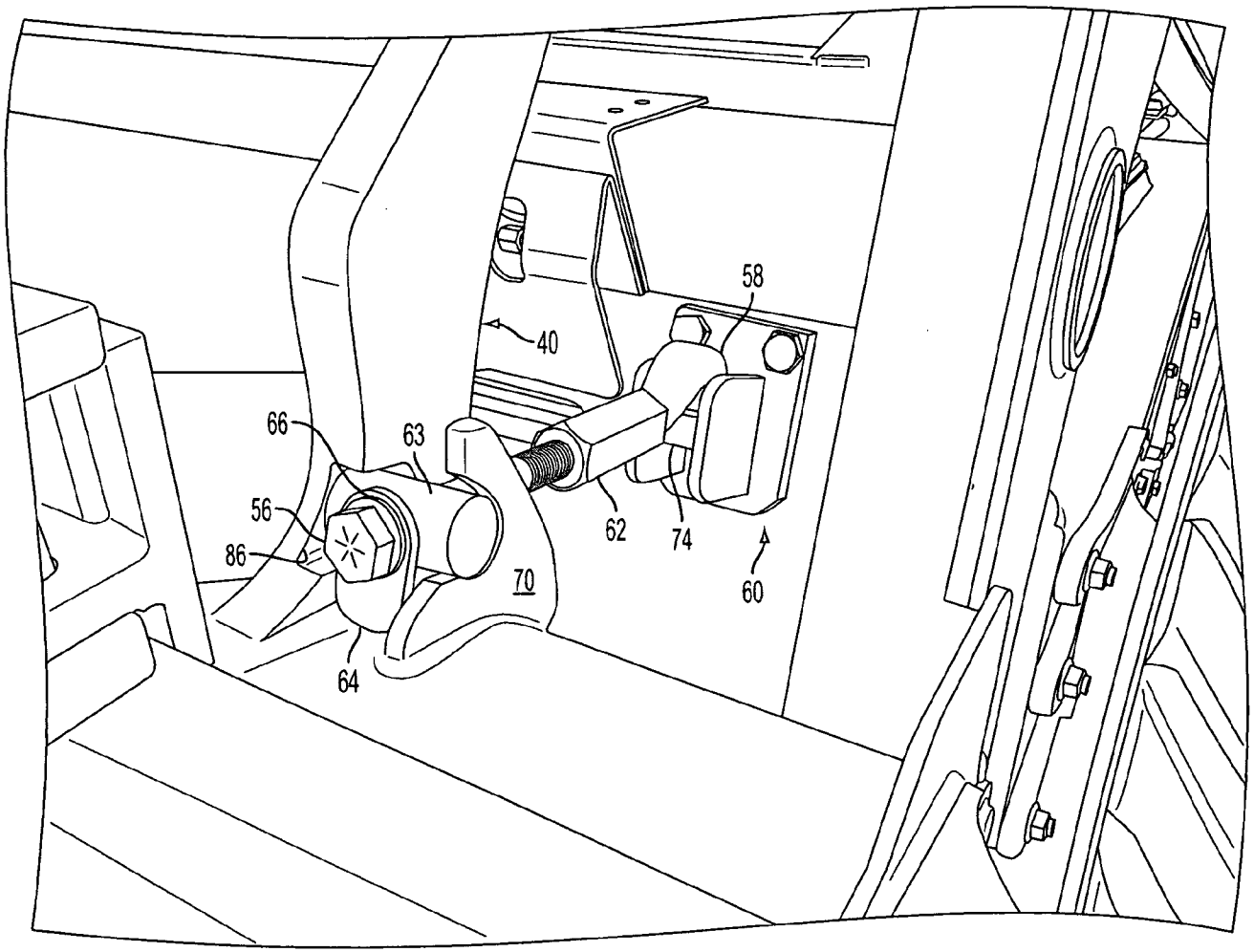
FIG. 8 is an illustration of an exemplary installation of the anchor hook assembly, anchor plate and hook of the connector device of the present invention according to a preferred embodiment.
Figure 12:
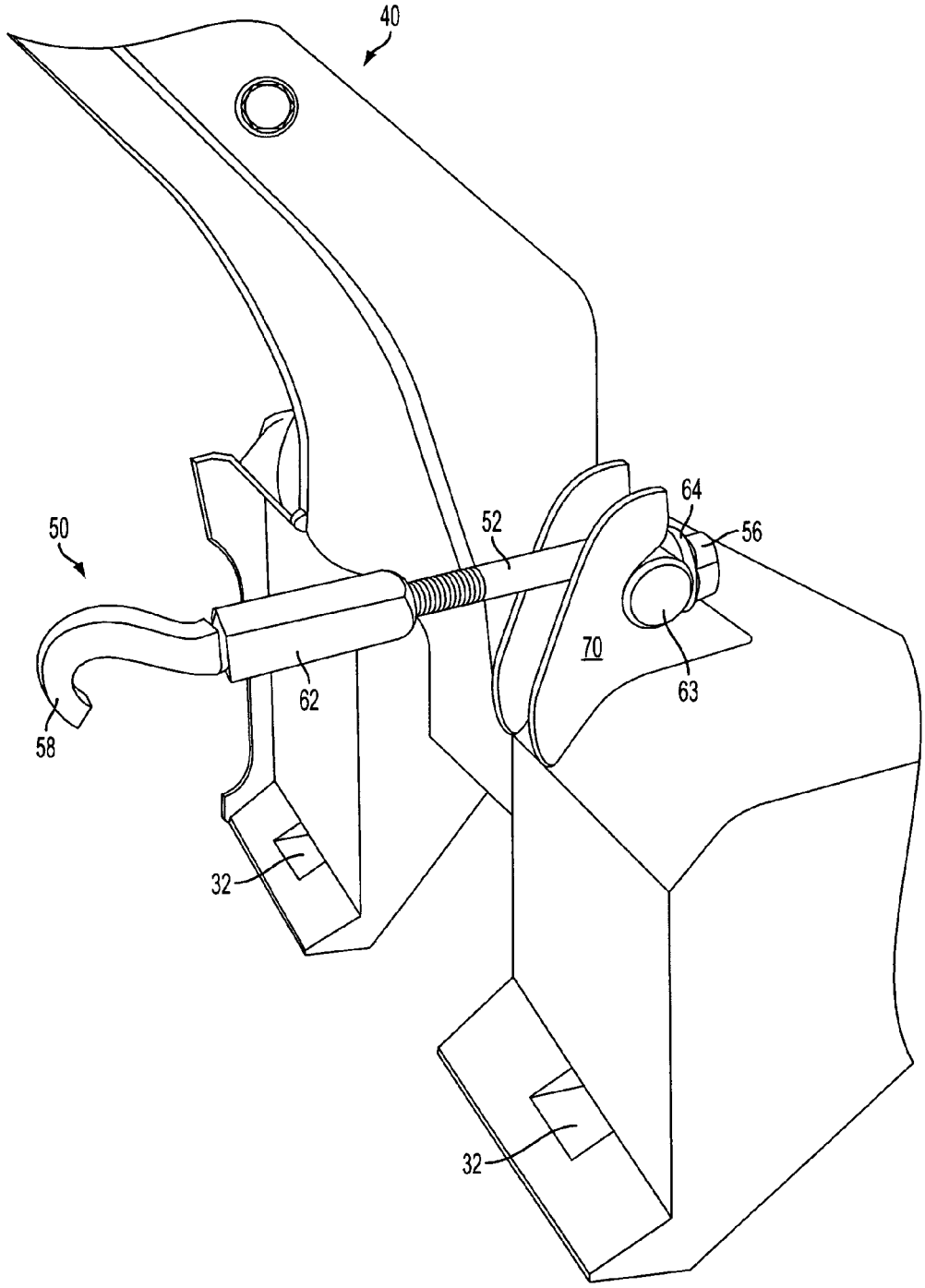
FIG. 12 is a full angle view of an exemplary installation of a pair of hooks coupling one end of the anchor hook assembly of the connector device of the present invention according to a preferred embodiment.
Figure 13A:
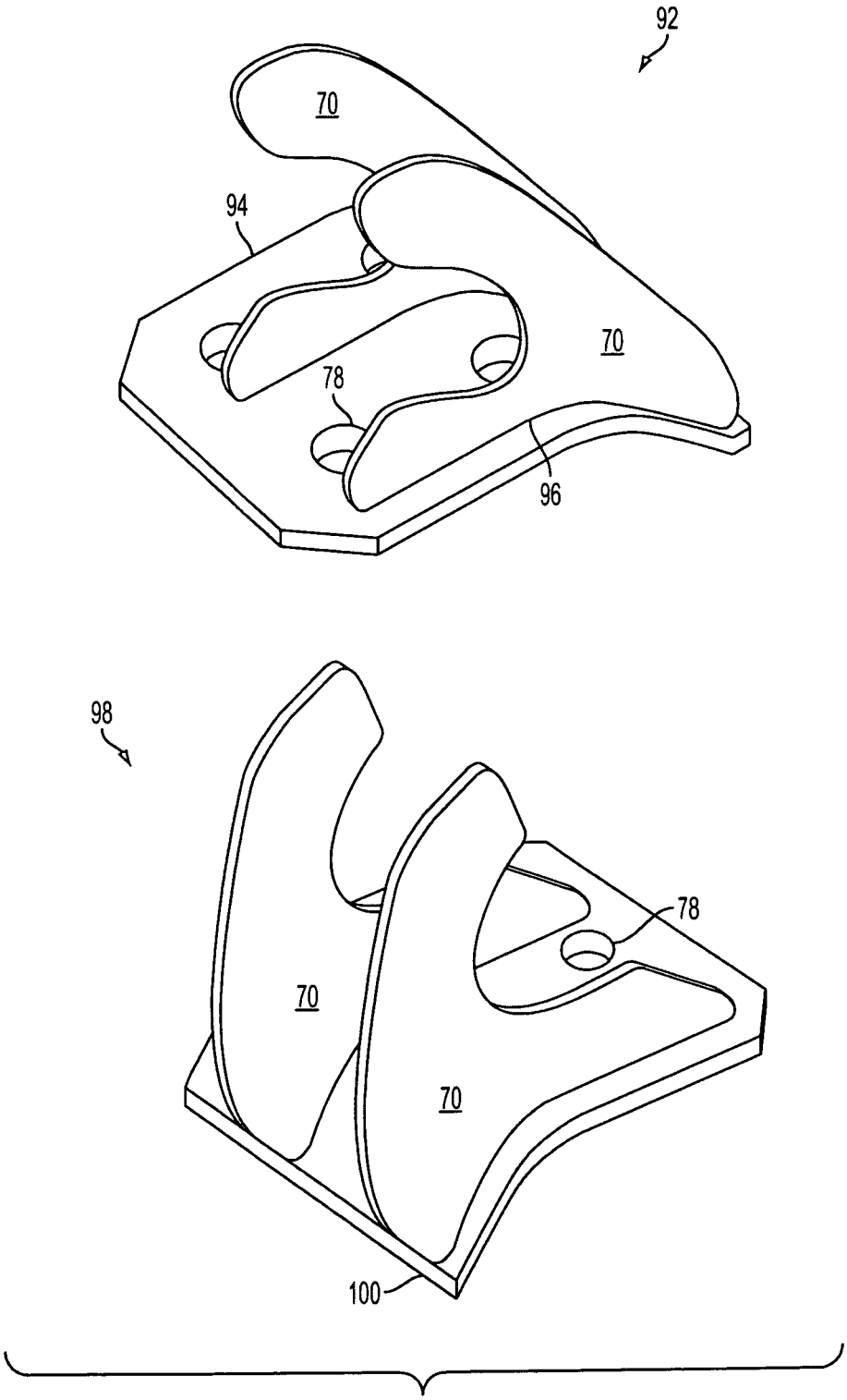
FIG. 13A is an angle view of the first part and second part of an exemplary pair of hooks of the connector device of the present invention according to a preferred embodiment.
Figure 13B:
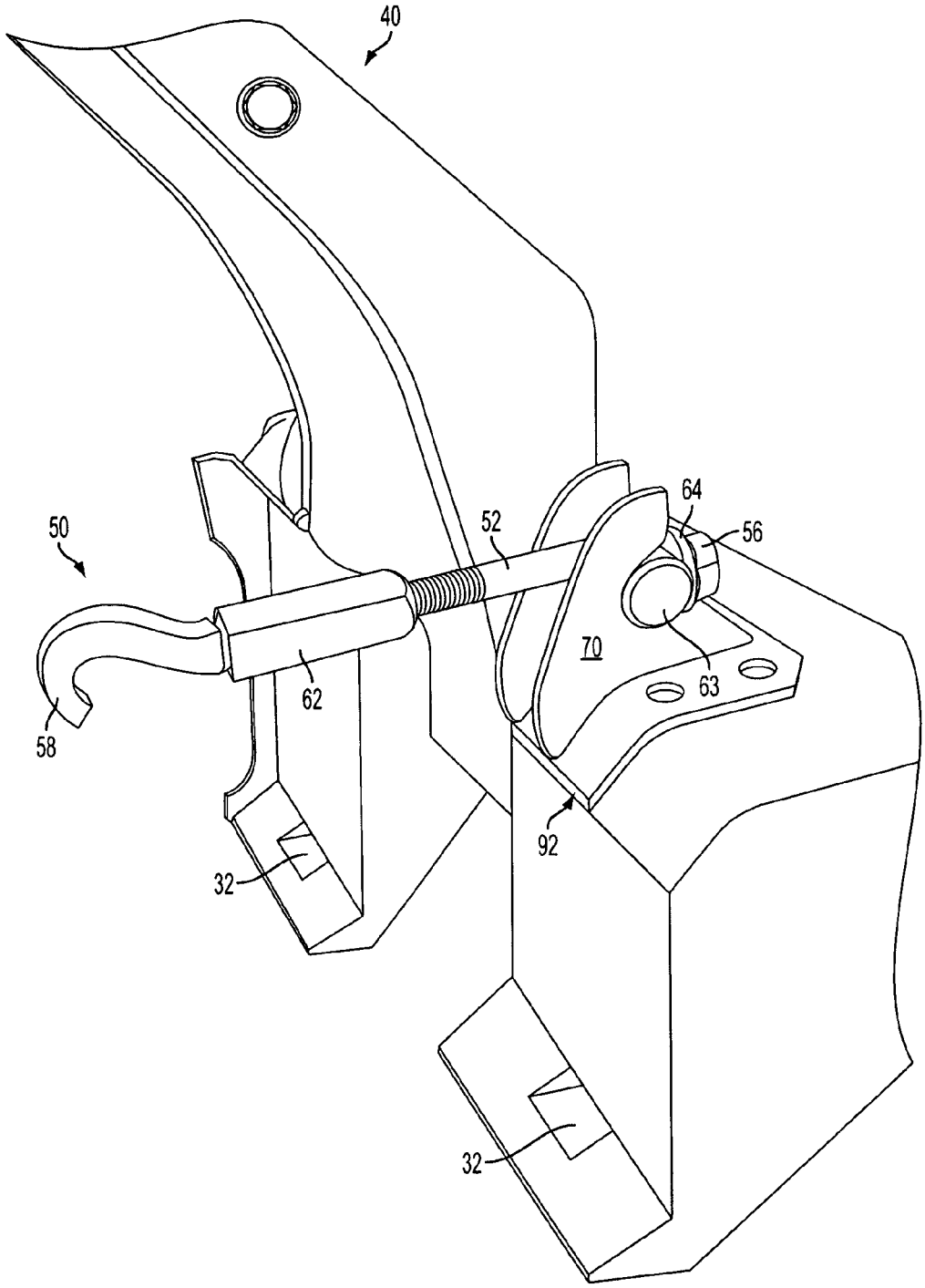
FIG. 13B is a full angle view of an exemplary installation of the first part of a pair of hooks coupling one end of the anchor hook assembly of the connector device of the present invention according to a preferred embodiment.

Fixedly attaching hook 70 on each side of the support base of control panel 40 is accomplished in an exemplary embodiment depicted in FIGS. 8, 12 and 13B. For ease of discussion, identification is made to the right and left hand sides of control panel 40, which correlates in FIG. 9 to the pair of corresponding anchor pads 60, one on the right hand side of the operator compartment 14 and one the other on the left hand side of compartment 14.

Referring back to FIG. 8, which illustrates the right hand side anchor pad 60 on the skid steer machine 10 and the right hand side of the support base of control panel 40, hook 70 is spaced an appropriate distance from control panel 40 to receive cylindrical pin 63 in a way that positions the open space 82 of hook 70 towards the boom feature 36 of the work tool accessory 34.

As depicted in FIG. 8, a cut-out 86 shaped in size and contour substantially the same as cylindrical pin 63, is formed in one side of the support base of control panel 40. In addition, the non-threaded end of adjusting bolt 52, which contains bolt head 56 and wedge lock washer assembly 64, 66, is positioned between hook 70 and one side of the support base of control panel 40, in such a way that allows cylindrical pin 63 to be hooked into space 82 and cut-out 86, and further allows wedge lock washer 64 to lock cylindrical pin 63 and adjusting bolt 52 in place, substantially preventing lateral movement therein. The other end of anchor hook assembly 50 in the form of anchor hook 58 is positioned for a hooked connection onto pin 74 of anchor pad 60.

A similar arrangement of hook 70 and anchor hook assembly 50 as described above, is installed on the left hand side of the support base of control panel 40 involving the anchor pad 60 on the left hand side of skid steer machine 10.

With both ends of anchor assembly 50 attached—namely, cylindrical pin 63 fixedly locked into cut-out 86 and open space 82 of hook 70 on one end, and anchor hook 58 securely hooked onto pin 74 of anchor pad 60 on the other end—on both sides of control panel 40, the work tool accessory 34 having a boom feature 36, on one end, is securely attached to the skid steer loader machine 10 on the other end.

Figure 9:
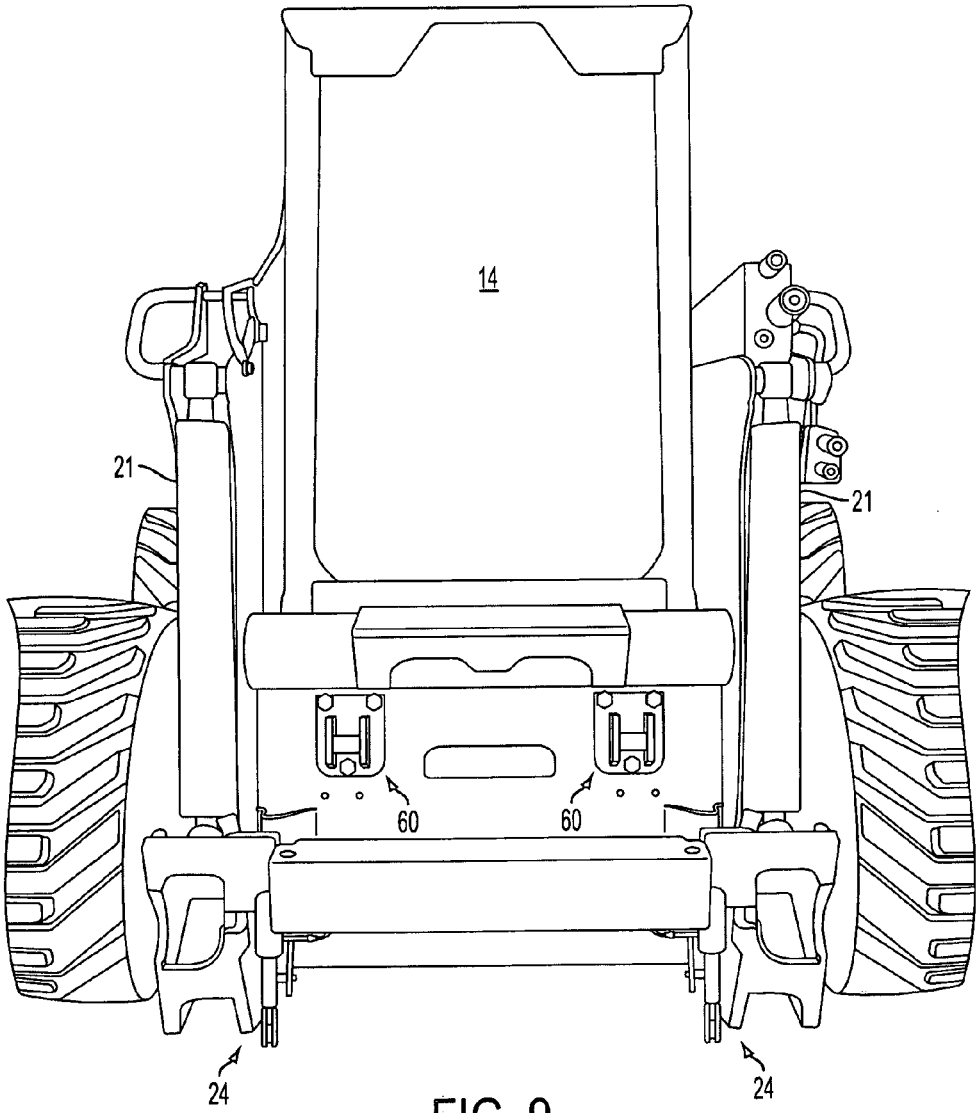
FIG. 9 is a front view of an exemplary installation of a pair of anchor plates of the connector device of the present invention according to a preferred embodiment.

As depicted in the preferred embodiment of FIG. 9, a pair of anchor pads 60 receives the hooked connection of a pair of anchor hook assemblies 50 (FIG. 4) on both sides of the control panel 40 (not shown). Each anchor pad 60 is preferably positioned on the body, not the lift arm, of the skid steer machine 10 and spaced apart in order to accommodate the width of the control panel 40.

In addition, each anchor pad 60 is preferably positioned below the operator's compartment 14 and above the coupler 24 in such a way that eliminates vertical movement of the lift arm. In other words, the left hand side anchor pad 60 is preferably positioned on the left hand side of and below operator compartment 14 at an appropriate height in order for the hooked connection of anchor hook 58 onto pin 74 to be in horizontal alignment with cylindrical pin 63 positioned into hook 70 (FIG. 8) and cutout 86 on the left hand side of control panel 40, and the right hand side anchor pad 60 is preferably positioned on the right hand side of and below compartment 14 at an appropriate height that facilitates horizontal alignment of anchor hook 58 onto pin 74, on one end of anchor hook assembly 50, with cylindrical pin 63 into another hook 70 and cutout 86, on the other end of anchor hook assembly 50, on the right hand side of control panel 40, as described above. Horizontal alignment of both ends of anchor hook assembly 50 connecting the skid steer loader 10 to the work tool accessory 34 substantially eliminates vertical lift arm movement.

Once work tool accessory 34 is coupled to skid steer loader 10 via coupler 24 and apertures 32 (FIG. 12), hydraulic tilt cylinder 21 is actuated to retract the work tool accessory 34 in a direction towards operator compartment 14, to facilitate coupling both ends of the anchor hook assembly 50 per FIG. 8 and as described above. Preferably, securing an appropriate hooked connection of anchor hook 58 onto pin 74 is achieved by turning bolt head 56, which in turn causes the threaded portion of adjusting bolt 52 to mate inwardly or outwardly into/out of hex nut 62 for appropriate adjustment and attachment.

Now, to achieve a stable and safe secure attachment of the work tool accessory 34 to the skid steer loader 10 without undesirable or unwanted machine instability, such as uncontrollable movement or dancing of the boom feature 36, a final component in the connector device of the present invention is at hand; namely, stop pad 80.

Figure 7:
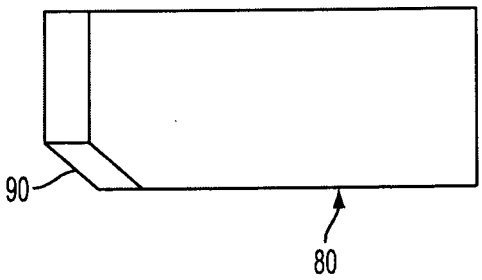
FIG. 7 is an angular view of the stop pad of the connector device of the present invention according to a preferred embodiment.

Referring now to FIG. 7, stop pad 80 is preferably a solid block of high strength steel useful to absorb and/or resist vibrational stresses caused by the tilt cylinder 21 and the breakout force of work tool accessory 34 having a boom feature 36.

Figure 10:
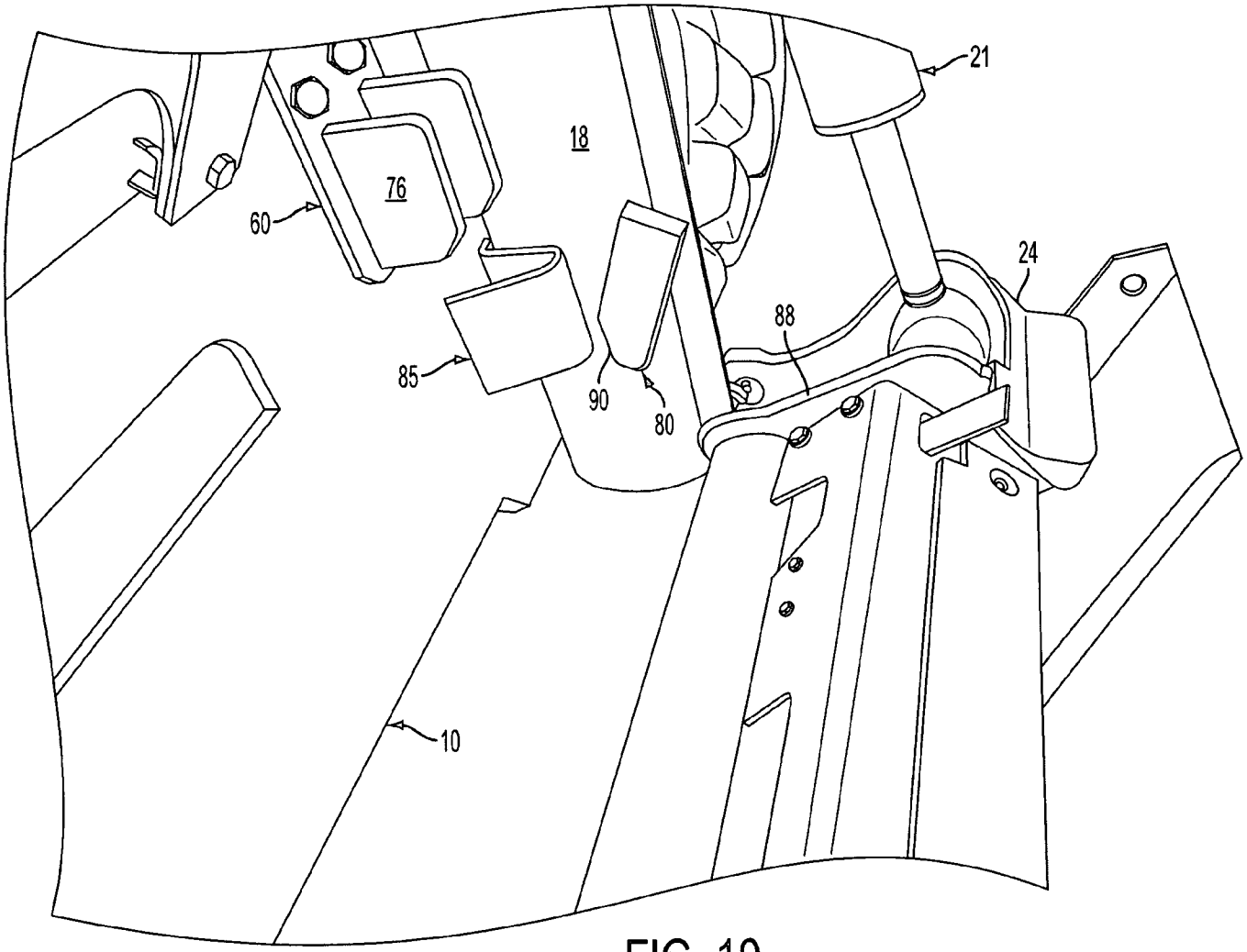
FIG. 10 is an angular view of an exemplary installation of the stop pad of the connector device of the present invention according to a preferred embodiment.

By way of installation, referring now to FIG. 10, stop pad 80 is fixedly attached near a distal end on each lift arm 18 of the skid steer loader 10. A preferred embodiment for fixedly securing stop pad 80 is by angular attachment to lift arm 18 in such a way that it serves as a backstop to coupler 24 by ensuring that a rear surface 88 of coupler 24 is substantially prevented from any further retracting movement in a direction toward lift arm 18. In this attachment arrangement, stop pad 80 substantially serves as a dead stop, or additional support stop, for coupler 24. Moreover, since the location of stop pad 80 on lift arm 18 is angularly positioned in the vicinity of lift hook 85, when lift arm 18 is in a down position in front of machine 10 as depicted in FIG. 10, one corner 90 of stop pad 80 may be removed or cut-off as desired, to avoid conflict with or better accommodate the loader machine's lift hook 85.

The dimension of stop pad 80 is sized to substantially: overcome undesirable equipment shaking; eliminate unwanted lateral movement; reduce equipment wear and tear; accommodate high reciprocating and/or vibrational stresses and/or loads; and the like. Stop pad 80 is preferably approximately one inch in thickness to accommodate any possible sideways movement of the rear surface 88 of coupler 24 that may occur during operation. Since a relatively small amount of lateral movement between the rear surface 88 of coupler 24 and lift arm 18 results in frequent and expensive re-bushing of the lift arm 18, stop pad 80 not only reduces unnecessary wear on the lift arm's pivot point bushings but translates into longer bushing life.

In addition, stop pad 80 is preferably approximately at least two inches wide and at least five and one-half inches long, which dimensions successfully prevents shaking of each lift arm 18 because stop pad 80 not only substantially withstands the pressure of tilt cylinder 21 but also the high breakout force and digging force of work tool accessory 34 having a boom feature 36. The length of stop pad 80 preferably covers a substantial length of the rear surface 88 of coupler 24 that it backstops.

As discussed above, a change in one dimensional aspect (length and/or height and/or thickness) of stop pad 80 generally results in a change in another dimensional aspect in order to maintain a desired minimum component strength, for instance, that withstands the reciprocating forces of the equipment involved.

Figure 11:
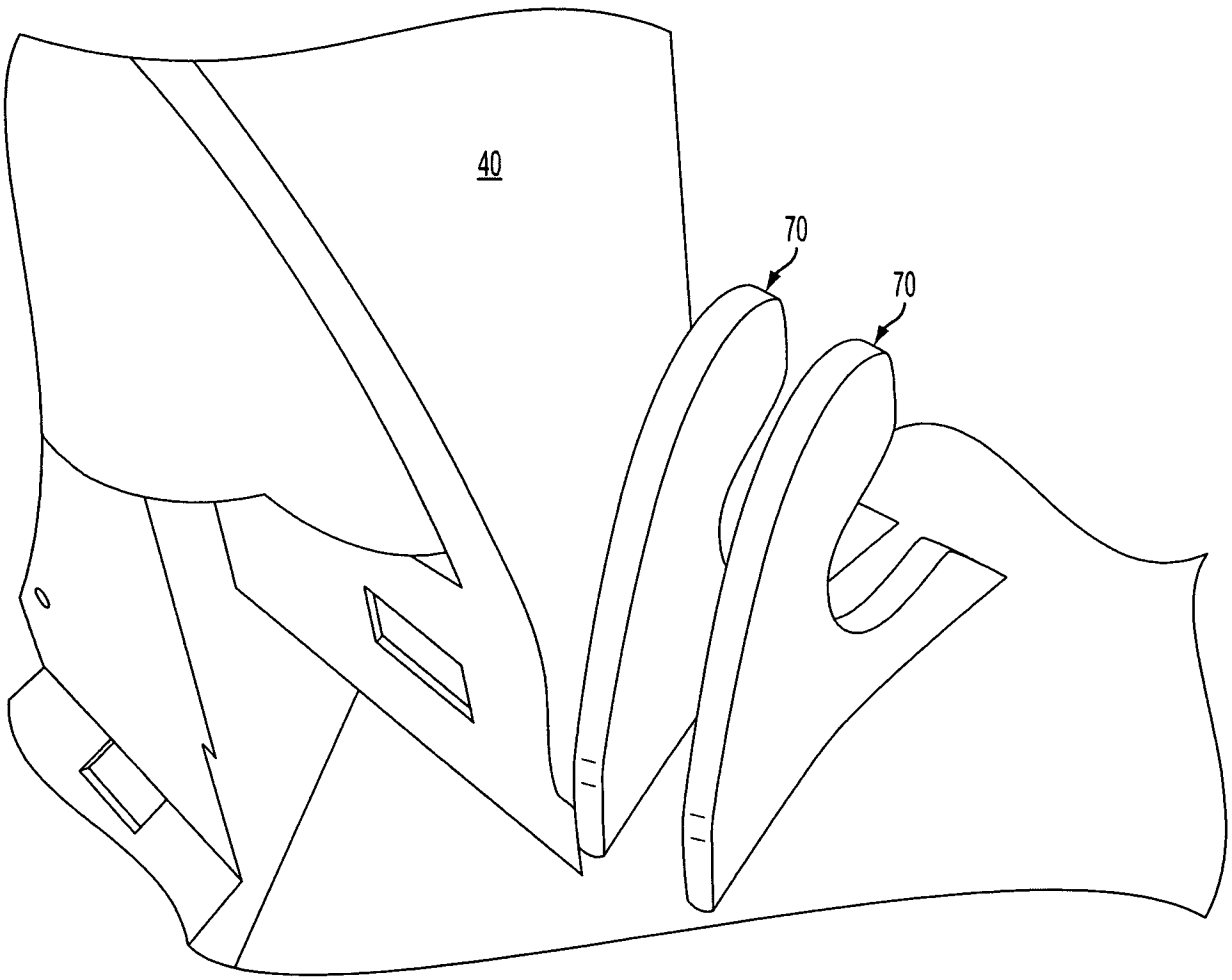
FIG. 11 is a partial angle view of an exemplary illustration of two hooks of the connector device of the present invention according to a preferred embodiment.

Referring now to FIG. 11, there is shown an exemplary illustration of two hooks 70 on the left hand side of control panel 40. As depicted, hooks 70 are preferably spaced apart to receive cylindrical pin 63 in open space 82 (not identified). Hooks 70 are preferably fixedly attached to a top surface of work tool accessory 34 as described above. The characteristics of each hook 70 are as described above.

FIG. 12 illustrates an exemplary installation of a pair of hooks 70 coupling one end of the anchor hook assembly 50 on the left hand side of control panel 40 of work tool accessory 34, according to a preferred embodiment of the invention. Use/operation of hook 70 is as earlier described with respect to FIG. 8. However, a pair of hooks 70 is preferably employed that is not only spaced an appropriate distance from the support base of control panel 40 to properly receive cylindrical pin 63, but is also spaced for appropriate alignment of hook 58 onto pin 74.

In addition, as earlier described, the pair of hooks 70 are positioned in such a way that each open space 82 of hook 70 is in a direction facing the boom feature 36 of the work tool accessory 34. In this regard, the non-threaded end of adjusting bolt 52, which contains bolt head 56 and wedge lock washer assembly 64, 66 (66 not shown), is positioned between both hooks in such a way that facilitates cylindrical pin 63 being hooked into space 82 and further facilitates wedge lock washer locking cylindrical pin 63 and adjusting bolt 52 in place, substantially preventing lateral movement therein. Anchor hook (FIG. 12) is positionable for hooked connection onto pin 74 (FIG. 8) of anchor pad 60 on the left hand side of compartment 14.

A preferred embodiment for fixedly attaching each hook 70 to a top surface of work tool accessory 34 is through the use of an electrode, having a minimum yield strength of approximately 68,000 psi and a tensile strength of approximately 78,000 psi, that is suited to attach the materials that loader machines 10 and work tool accessories 34 are made of.

Referring now to FIG. 13A, there is shown an exemplary pair of hooks 70 in accordance with a preferred embodiment of the connector device of the present invention. The pair of hooks 70 comprises a first part 92, which includes hooks 70 and hook plate 94 for one side of control panel 40, and a second part 98, which includes hooks 70 and hook plate 100 for the other side of control panel 40. In keeping with the two sided identification of control panel 40 in terms of FIG. 9's anchor pads 60, the first part 92 may be described as the pair of hooks configured for the left hand side of control panel 40, and the second part may be described as the pair of hooks configured for the right hand side of control panel 40.

Preferably, in first part 92, a pair of hooks 70 is positioned on hook plate 94 in spaced relation to each other, as earlier described, except that one of the hooks 70 is fixedly secured nearest the left edge of hook plate 94, such as between the range of approximately one-half to one inch from the left edge (near reference number 96) of hook plate 94. To the immediate right of this left-edge or left-justified hook 70, spaced alongside its width, are one or more apertures 78 for securing hook plate 94 to the work tool accessory 34. As the second hook 70 is already in spaced relation to the left-edge hook, in order to accommodate cylindrical pin 63 as earlier described, another set of one or more apertures 78 is preferably located immediately to the right thereof.

As with the cylindrical pin 63 depicted in FIG. 12, for example, in FIG. 13A the axial areas of cylindrical pin 63 in the vicinity of the diameter of adjusting bolt 52, are also preferably supported on both sides each by hooks 70 in first part 92. As earlier discussed, the support distance of cylindrical pin 63 between the two hooks 70 on hook plate 94 is preferably the size of the wedge lock washer 64 positioned therebetween, which is approximately two inches.

Preferably two apertures 78, which support each hook 70, are spaced along the width of the hook 70 it supports. Since, in one application, for example, one hook 70 is left justified approximately one-half inch or less from the left edge of hook plate 94, this means that two apertures 78 to the immediate right of this hook are spaced along the width of this hook 70. Approximately two inches from the left-justified hook 70 is the second hook 70 with another two apertures 78 spaced along its width, also preferably one-half inch or less, to its right.

In addition, hook plate 94 approximates the shape of the bottom surfaces 96 of each hook 70. As described above, the shape of the bottom surfaces 96 of hook 70 and thereby the shape of hook plate 94, preferably approximates the shape of the top surface of the work tool accessory 34. Preferably, hooks 70 in first part 92 as well as in second part 98 are fixedly attached through the use of appropriate materials suited for attachment to loader machines 10 and work tool accessories 34, or the first and second parts 92, 98 may be integrally formed or of unitary construction with hook plate 94, 100, respectively.

Hooks 70 are as earlier described herein without further repetition, therefore hook plate 94, 100 is sized to accommodate the above described arrangement of hooks 70 in first and second parts 92, 98, respectively. Preferably, fasteners 72 attach hook plate 94, 100 to the work tool accessory 34.

Still referring to FIG. 13A, second part 98 includes a pair of hooks 70 and apertures 78 on a hook plate 100 as similarly described above with reference to first part 92, except that in second part 98 one of the hooks 70 is positioned nearest the right edge of hook plate 100, such as approximately one-half inch or less from the right edge of hook plate 100.

Preferably two apertures 78 (some not viewable), which support each hook 70 in second part 98, are spaced along the horizontal width to the left of the hook 70 it supports. Similarly, since approximately two inches separate the right-justified hook 70 from the other hook 70, hook plate 100 is also sized to accommodate the above described arrangement of the pair of hooks 70 for second part 98, and fasteners 72 are usable to attach hook plate 100 to the work tool accessory 34.

The left- and right-justified hook configuration of first and second parts 92, 98, respectively, operates complementarily with the control panel 40 of the work tool accessory 34 having a boom feature 36 in that placement of the left-justified hook configuration of first part 92 complements the left hand side of control panel 40, and placement of the right-justified hook configuration of second part 98 complements the right hand side of control panel 40.

Accordingly, the left-justified and right-justified hook configuration of first and second part 92, 98, respectively, of the pair of hooks 70 not only eliminates user dangers, error and confusion, but it also provides for safe and convenient quick attachment and removal, if necessary, all of which translates into valued savings of time, health and cost.

Referring now to FIG. 13B, there is shown an exemplary installation of first part 92. A similar installation arrangement is configured on the other side of control panel 40 involving the other anchor pad 60 on that side of the skid steer machine 10.

Once work tool accessory 34 is coupled to skid steer loader 10 via coupler 24 (FIG. 9) and apertures 32 (FIG. 13B), for example, where a rear surface 88 of coupler 24 is retracted to its fullest position against stop pad 80 (FIG. 10), and locked adjustment of anchor hook 58 (FIG. 13B) onto the pin 74 in anchor pad 60 has occurred, conditions are ideal for alignment and attachment of the first part 92 (hooks 70 and hook plate 94) and second part 98 (hooks 70 and hook plate 100) onto the work tool accessory 34.

Preferably, alignment and locked connection of the cylindrical pin 63 of anchor hook assembly 50 into hooks 70 of first part 92, in alignment with hooked connection of anchor hook 58 onto pin 74 is as previously described. Similarly, this procedure is repeated for alignment and locked connection of cylindrical pin 63 into hooks 70 of second part 98, in alignment with hooked connection of anchor hook 58 onto pin 74, also as previously described. Upon completion, hook plate 94, 100 is fixedly attached to work tool accessory 34 via fasteners 72, and safe, stable operation of the boom feature 36 can be had.

The present invention has been described with reference to preferred embodiment(s) and exemplary application(s), which are intended to illustrate the principles of the invention without limiting the scope of the invention. Other embodiments in addition to the preferred embodiments disclosed herein may be made from consideration of the specification and practice of the disclosed apparatus, without departing from the scope of the following claims and equivalents. All suitable modifications and equivalents of carrying out the invention are contemplated as being within the scope of the following claims particularly pointing out and distinctly claiming the subject matter regarded as the invention.

What I claim is:

1. A connector device coupling a skid steer loader to a work tool accessory, said connector device comprising:

(a) a pair of anchor hook assemblies each comprising an adjusting bolt, an anchor hook, a hex nut one end of which matingly connects said anchor hook, a pin positioned between said hex nut and a bolt head of said adjusting bolt, and a washer assembly positioned between said pin and said bolt head;

(b) a pair of anchor pads, for coupling to a skid steer loader, each comprising an anchor plate, a pair of flanges spatially position on said anchor plate, and a pin attaching said pair of flanges therebetween, each anchor pad receives each said anchor hook; and (c) a pair of hooks, for coupling to a work tool accessory, comprising a first part and a second part, said first part including two hooks spatially positioned on a first hook plate, said second part including two hooks spatially positioned on a second hook plate, each said two hooks receives therebetween the pin of each anchor hook assembly.

2. The connector device according to claim 1, one hook in said first part positioned nearest a left edge of said first hook plate.

3. The connector device according to claim 1, one hook in said second part positioned nearest a right side edge of said second hook plate.

4. The connector device according to claim 1, each hook supporting an axial area of said pin surrounding a diameter of said adjusting bolt.

5. The connector device according to claim 1, each hook decreasing in dimension from a bottom upwardly, a back region sloping at a gradual incline upwardly from a rear of the hook, and a rear which slope inclines at a rate greater than the slope of said back region.

6. The connector device according to claim 1, an area of the hook behind and below an open space in the hook approximating two-thirds of the area of the hook.

7. The connector device according to claim 1, each hook having a front base portion extending beyond a top point of the hook.

8. The connector device according to claim 1, said washer assembly locking said anchor hook assembly pin against lateral movement.

9. The connector device according to claim 1, said stop pad backstopping a rear surface of a coupler of said skid steer loader.

10. The connector device according to claim 1, said anchor hook is curved in the shape of a "c".

11. The connector device according to claim 1, said anchor hook assembly pin is a cylindrical pin.

12. The connector device according to claim 1, comprising a stop pad angularly attached in a vicinity of a distal end on a lift arm of said skid steer loader.

13. A method of using a connector device coupling a skid steer loader to a work tool accessory, said method comprising the steps of:

(a) installing a pair of hooks on a work tool accessory, each pair comprising a first part and a second part, by securing a first part including two hooks spatially positioned on a first hook plate, on one side of a control panel, and securing a second part including two hooks spatially positioned on a second hook plate, on another side of a control panel;

(b) installing a pair of anchor pads on said loader, each pair comprising an anchor plate, a pair of flanges spatially position on said anchor plate, and a pin attaching said pair of flanges therebetween;

(c) coupling the work tool accessory to said skid steer loader with a pair of anchor hook assemblies such that each anchor hook of each anchor hook assembly receives each anchor pad attached on said loader, and each pin of each anchor hook assembly is received into said first part and said second part, respectively, each pair comprising an adjusting bolt, an anchor hook, a hex nut one end of which matingly connects said anchor hook, and a pin positioned between said hex nut and a bolt head of said adjusting bolt;

(d) installing a stop pad on said loader, backstopping a rear surface of a coupler of said skid steer loader against further movement.

* * * * *